US005370987A

United States Patent [19]

Kobayashi et al.

[11] Patent Number: 5,370,987

[45] Date of Patent: Dec. 6, 1994

[54] HEAT-DEVELOPABLE PHOTOSENSITIVE MATERIAL

[75] Inventors: Motokazu Kobayashi; Tetsuro Fukui, both of Kawasaki; Miki Tamura, Isehara; Kenji Kagami, Atsugi; Masao Suzuki, Tokyo; Katsuya Nishino, Hiratsuka, all of Japan

[73] Assignee: Canon Kabushiki Kaisha, Tokyo, Japan

[21] Appl. No.: 53,000

[22] Filed: Apr. 27, 1993

[30] Foreign Application Priority Data

Apr. 30, 1992 [JP] Japan ..... 4-111523

[51] Int. Cl.[5] ..... G03C 1/498

[52] U.S. Cl. ..... 430/619; 430/203; 430/271; 430/273; 430/512; 430/523

[58] Field of Search ..... 430/523, 619, 203, 631, 430/512, 271, 273

[56] References Cited

U.S. PATENT DOCUMENTS

| | | | |
|---|---|---|---|
| 4,055,432 | 10/1977 | Masuda et al. | 430/523 |
| 4,220,709 | 9/1980 | deMauriac | 430/353 |
| 4,752,559 | 6/1988 | Helland et al. | 430/523 |
| 4,942,115 | 7/1990 | Przezdziecki | 430/619 |
| 5,001,032 | 3/1991 | Katayama et al. | 430/203 |
| 5,064,744 | 11/1991 | Fukui et al. | 430/255 |
| 5,171,657 | 12/1992 | Kagami et al. | 430/271 |
| 5,187,041 | 2/1993 | Mouri et al. | 430/201 |

FOREIGN PATENT DOCUMENTS

| | | |
|---|---|---|
| 43-4924 | 2/1968 | Japan . |
| 43-4921 | 4/1968 | Japan . |
| 45-18416 | 6/1970 | Japan . |
| 55-50246 | 4/1980 | Japan . |
| 58-118638 | 7/1983 | Japan . |
| 58-118639 | 7/1983 | Japan . |
| 59-13728 | 3/1984 | Japan . |
| 59-55429 | 3/1984 | Japan . |
| 2-4889 | 1/1990 | Japan . |
| 3-135564 | 6/1991 | Japan . |

*Primary Examiner*—Thorl Chea

*Attorney, Agent, or Firm*—Fitzpatrick, Cella, Harper & Scinto

[57] ABSTRACT

A heat-developable photosensitive material is disclosed which has a support and a photosensitive layer containing at least an organic silver salt, a silver halide and a reducing agent, a water-soluble polymeric layer containing a water-soluble polymeric material, and a hydrophobic polymeric layer containing a hydrophobic polymeric material.

6 Claims, 1 Drawing Sheet

HEAT-DEVELOPABLE PHOTOSENSITIVE MATERIAL

BACKGROUND OF THE INVENTION

1. Field of the invention

The present invention relates to a heat-developable photosensitive material making use of an organic silver salt.

2. Related Background Art

Silver salt photography making use of a silver halide is a recording technique which has been hitherto widely put into use because of excellent sensitivity and gradation. In this photography, however, after imagewise exposure the processing including developing, stopping and fixing is carried out by a wet process, and hence its deficiencies in operability, simplicity and safety have been questioned. As a countermeasure therefor, research has been made on dry-process materials that do not require such wet processing, as disclosed in Japanese Patent Publication Nos. 43-4921, No. 43-4924, etc. These disclosures are concerned with a technique in which a photosensitive silver halide is used in an amount required as a catalyst and a non-photosensitive organic silver salt is used as an image forming agent. The mechanism by which the organic silver salt acts as an image forming agent can be explained as follows: (1) A silver nucleus is produced from a photosensitive silver halide as a result of exposure, and it forms a latent image. (2) The silver nucleus serves as a catalyst, an organic silver salt and a reducing agent cause oxidation-reduction reaction upon heating, and the organic silver salt is reduced to metallic silver, which forms a visible image.

As an example of methods of utilizing such a heat-developable photosensitive material, Japanese Patent Application Laid-open No. 55-50246 discloses a method of use as a mask. In this method, a silver image is used as a mask. As a photosensitive material capable of obtaining a polymer image with much better contrast than those utilizing the silver image mask, Japanese Patent Application Laid-open No. 3-135564 discloses a photosensitive material that utilizes light absorption of a light-absorbing organic compound that is an oxidized product of a reducing agent, to form an image with a better contrast.

Meanwhile, a protective layer used in the above dry-process materials is disclosed, for example, in Japanese Patent Publication No. 59-13728. This publication discloses an acrylic resin composition improved in impact strength. Japanese Patent Publication No. 2-4889 also discloses as a material for a topcoat polymer layer polyvinyl butyral, polystyrene, polymethyl methacrylate or polyurethane rubber.

However, in conventional heat-developable photosensitive materials, there has been the problem that the moisture in the air enters into a photosensitive layer through the protective layer to lower sensitivity, making it impossible to store such materials over a long period of time as unused materials. In addition, in conventional heat-developable photosensitive materials, the protective layer tends to be softened by the heat generated during heat development to cause scratches on the surface of the protective layer, or cause what is called bleeding wherein components in the photosensitive layer migrate to the surface of the protective layer in a powdery state, resulting in adhesion of a nonwoven fabric constituting a heating element to the protective layer surface. There also has been the problem that images undergo distortion because of an insufficient strength of the protective layer upon application of an external force to the photosensitive material when the protective layer is softened by the heat generated during heat development.

SUMMARY OF THE INVENTION

An object of the present invention is to provide a heat-developable photosensitive material that can be free from a reduction in sensitivity even after its storage over a long period of time, and also can be free from scratches, bleeding and image distortion.

The heat-developable photosensitive material of the present invention comprises a support and provided thereon a photosensitive layer containing at least an organic silver salt, a silver halide and a reducing agent, a water-soluble polymeric layer containing a water-soluble polymeric material, and a hydrophobic polymeric layer containing a hydrophobic polymeric material.

DESCRIPTION OF THE PREFERRED EMBODIMENTS

Figure 1:
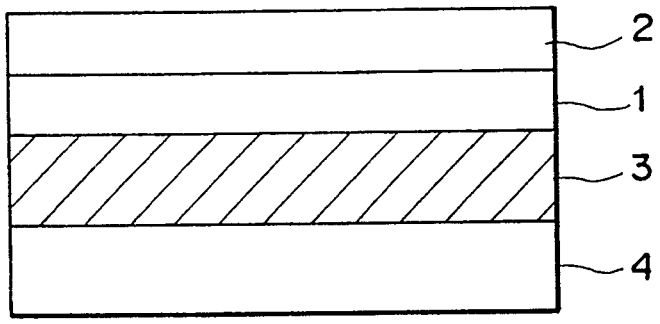
FIG. 1 is a side cross section to show an example of the heat-developable photosensitive material according to the present invention.

The heat-developable photosensitive material of the present invention has, as shown in FIG. 1, a photosensitive layer 3 on a support 4. On the photosensitive layer 3, a water-soluble polymeric layer 1 and a hydrophobic polymeric layer 2 are provided.

The water-soluble polymeric layer 1 contains a water-soluble polymeric material. In the present invention, the water-soluble polymeric material refers to a polymeric material capable of being dissolved by 1 g or more based on 100 g of water. It is preferable to use a water-soluble polymeric material capable of being dissolved by 5 g or more based on 100 g of water. When the water-soluble polymeric material is dissolved in water, it may be heated.

The water-soluble polymeric material used in the present invention may include, for example, polyvinyl alcohol, modified polyvinyl alcohol, polyethylene oxide, casein, starches, vinyl acetate alcohol, celluloses, gelatins, gum arabic, polyvinyl pyrrolidone, alkali salts of acrylate or methacrylate copolymers, alkali salts of a styrene/maleic anhydride copolymers, and acrylamide copolymers, to which the material is by no means limited. Any water-soluble polymeric materials having the above performance can be widely used. These may be used alone or in combination of two or more kinds.

The water-soluble polymeric material may preferably be contained in an amount of from 20 to 100% by weight, and more preferably from 30 to 100% by weight, based on the water-soluble polymeric layer 1. Besides the water-soluble polymeric material, a pigment such as caolin, clay, talc, calcium carbonate, calcined clay, titanium oxide, diatomaceous earth, silica, aluminum silicate, magnesium silicate or aluminum oxide may be added to the water-soluble polymeric layer 1 so that the strength and adhesion of the coating film can be improved.

The water-soluble polymeric layer may preferably have a thickness of from 0.1 μm to 20 μm, and more preferably from 0.3 μm to 10 μm.

The hydrophobic polymeric layer 2 contains a hydrophobic polymeric material. In the present invention, the hydrophobic polymeric material refers to a material having a solubility of less than 1 g in 100 g of water. The hydrophobic polymeric material may also preferably be those having a water vapor permeability (JIS-Z0208) of 50 g/m$^2$ or less in a period of 24 hours.

The hydrophobic polymeric material used in the present invention may typically include, for example, resins such as polyfluoroethylene, polyfluorochloroethylene, polyvinyl fluoride, polyethylene, polypropylene, polystyrene, polyethylene terephthalate, polyvinyl chloride, chlorinated polyvinyl chloride, polymethyl methacrylate, polyacrylonitrile, rubber hydrochloride, a vinylidene chloride/vinyl chloride copolymer, a vinylidene chloride/acrylonitrile copolymer, a vinylidene chloride/isobutylene copolymer, a vinyl chloride/-diethyl fumarate copolymer, and norbornene resins. These may be used alone or in combination of two or more kinds.

The hydrophobic polymeric material may preferably be contained in an amount of from 20 to 100%, and more preferably from 30 to 100%, based on the hydrophobic polymeric layer 2. Besides the hydrophobic polymeric material, a pigment such as caolin, clay, talc, calcium carbonate, calcined clay titanium oxide, diatomaceous earth, silica, aluminum silicate, magnesium silicate or aluminum oxide may be added to the hydrophobic polymeric layer 2 so that the strength and adhesion of the coating film can be improved.

The hydrophobic polymeric layer 2 may preferably have a thickness of from 0.1 μm to 20 μm, and more preferably from 0.3 μm to 10 μm.

The hydrophobic polymeric layer 2 can prevent the moisture in the air from entering into the photosensitive layer 3 during the storage of the heat-developable photosensitive material. The water-soluble polymeric layer 1 thus provided makes it possible to prevent bleeding. In addition, the lamination of the water-soluble polymeric layer 1 and hydrophobic polymeric layer 2 makes it possible to prevent scratches and image distortion.

In the hydrophobic polymeric layer 2 or in the water-soluble polymeric layer 1, an ultraviolet absorbent may preferably be contained. This makes it possible to prevent unexposed areas of the photosensitive layer 3 from gradually blackening with lapse of time. The ultraviolet absorbent may be mixed with a binder to form an ultraviolet absorbing layer, which may be provided on the surface, on the back or between layers of the heat-developable photosensitive material of the present invention.

As the ultraviolet absorbent, for example, the following may preferably be used.

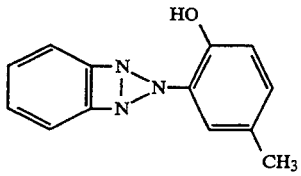

-continued

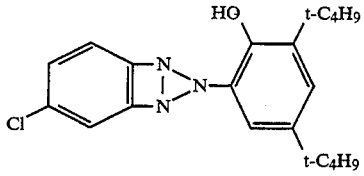

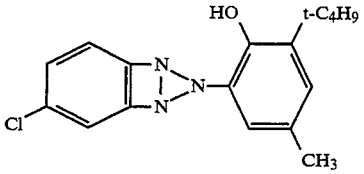

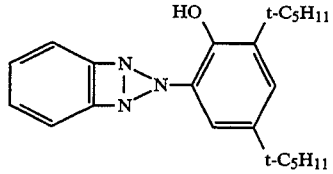

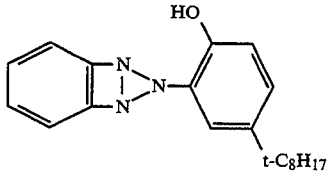

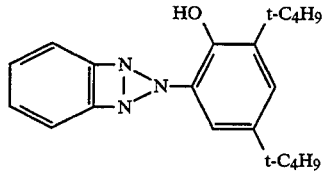

As the binder used in the ultraviolet absorbing layer, it is possible to use binders conventionally used, as exemplified by nitrocellulose cellulose phosphate, methyl cellulose, ethyl cellulose, polystyrene, polyvinyl chloride, polyvinyl acetate, polyvinyl butyral, a styrene/-butadiene copolymer and polymethyl methacrylate.

The ultraviolet absorbent may preferably be contained in an amount of from 0.05 to 1.0 g, and more preferably from 0.1 to 0.5 g, based on 100 g of the water-soluble polymeric material, hydrophobic polymeric material or binder.

The photosensitive layer 3 contains at least an organic silver salt, a photosensitive silver halide and a reducing agent.

The photosensitive silver halide used in the photosensitive layer 3 may include silver chloride, silver bromide, silver chlorobromide, silver iodobromide and silver chloroiodobromide.

With regard to the crystal form, the silver halide may include cubic, octahedral and tabular silver halides. In particular, a cubic or tabular silver halide is preferred. The cubic Silver halide may preferably have a side length of from 0.01 to 2 μm, and more preferably from 0.02 to 1 μm.

The tabular silver halide may preferably have an average aspect ratio of from 100:1 to 3:1, and more preferably from 50:1 to 5:1. It may preferably have a grain diameter of from 0.01 to 2 μm, and more preferably from 0.02 to 1 μm.

These silver halides may have been subjected to chemical sensitization carried out on conventional photographic emulsions. More specifically, sulfur sensitization, noble metal sensitization and reduction sensitization can be used. They may also be subjected to optical sensitization. To the optical sensitization, a method making use of an optical sensitizer can be applied. As the optical sensitizer, cyanine dyes, merocyanine dyes, xanthene dyes, etc. are preferably used.

The silver halide may have a uniform halogen composition in a grain, or a multiple structure having a different halogen composition in a grain. For the photosensitive silver halide, two or more kinds of silver halide having different halogen composition, grain size, grain size distribution, etc. may be used in combination.

As the organic silver salt, it is possible to use organic acid silver salts and triazole silver salts as disclosed in SHASHIN KOGAKU NO KISO (Basic Photographic Engineering), First Edition, Korona-sha Co., Japan Photographic Society, 1982, The Volume of Non-silver salts, p. 247, or Japanese Patent Application Laid-open No. 59-55429. It is preferred to use silver salts with a low photosensitivity. They may include, for example, silver salts of aliphatic carboxylic acids, aromatic carboxylic acids, mercapto group or α-hydrogen-containing thiocarbonyl group compounds, and imino group-containing compounds.

The aliphatic carboxylic acids may include acetic acid, butyric acid, succinic acid, sebacic acid, adipic acid, oleic acid, linolic acid, lenolenic acid, tartaric acid, palmitic acid, stearic acid, behenic acid and camphor acid. In general, silver salts having a smaller number of carbon atoms are proportionally not stabler, and hence those having an appropriate number of carbon atoms (e.g., those having 16 to 26 carbon atoms) are preferred.

The aromatic carboxylic acids may include benzoic acid derivatives, quinolinic acid derivatives, naphthalene carboxylic acid derivatives, salicylic acid derivatives, gallic acid, tannic acid, phthalic acid, phenyl acetic acid derivatives, and pyromellitic acid.

The compounds having a mercapto or thiocarbonyl group may include 3-mercapto-4-phenyl-1,2,4-triazole, 2-mercaptobenzoimidazole, 2-mercapto-5-aminothiadiazole, 2-mercaptobenzothiazole, S-alkylthioglycolic acid (alkyl group carbon atom number of 12 to 23), dithiocarboxylic acids such as dithioacetic acid, thioamides such as thiostearoamide; 5-carboxy-1-methyl-2-phenyl-4-thiopyridine, mercaptotriazine, 2-mercaptobenzoxazole, mercaptooxadiazole, 3-amino-5-benzylthio-1,2,4-triazole, which are mercapto compounds disclosed in U.S. Pat. No. 4,123,274.

The compounds having an imino group may typically include benzotriazole or derivatives thereof, described in Japanese Patent Publication No. 44-30270 or No. 45-18416, as exemplified by benzotriazole, alkyl-substituted benzotriazoles such as methylbenzotriazole, halogen-substituted benzotriazoles such as 5-chlorobenzotriazole, carboimidobenzotriazoles such as butylcarboimidobenzotriazole, nitrobenzotriazoles as disclosed in Japanese Patent Application Laid-open No. 58-118639, sulfobenzotriazole, carboxybenzotriazole OR salts thereof, or hydroxybenzotriazole, disclosed in Japanese Patent Application Laid-open No. 58-115638, 1,2,4-triazole, disclosed in U.S. Pat. No. 4,220,709, or 1H-tetrazole, carbazole, saccharin, imidazole and derivatives thereof.

The reducing agent used in the present invention is capable of producing silver by reducing an organic salt, when heated in the presence of silver nuclei produced as a result of exposure of the photosensitive silver halide. Such a reducing agent may include monophenols, bisphenols, trisphenols, tetrakisphenols, mononaphthols, bisnaphthols, dihydroxynaphthalenes, sulfonamidophenols, biphenols, trihydroxynaphthalenes, dihydroxybenzenes, trihydroxybenzenes, tetrahydroxybenzenes, hydroxyalkyl monoethers, ascorbic acids, 3-pyrazolidones, pyrazolones, pyrazolines, saccharides, phenylenediamines, hydroxyamines, reductones, hydroxamic acids, hydrazines, hydrazides, amidoximes and N-hydroxyureas. Of these, p-bisphenols, o-bisphenols, bisnaphthols, p-substituted phenols, 4-substituted naphthols are particularly preferred. The reducing agents disclosed in Japanese Patent Application Laid-open No. 3-135564 are also preferably used.

A tone modifier may be optionally added to the photosensitive layer 3. As the tone modifier, phthalazines, phthalazinones, benzoxazinediones, etc. are preferred.

A binder may also be appropriately contained in the photosensitive layer 3 for the purpose of improving film forming properties and dispersibility.

The binder may include cellulose esters as exemplified by nitrocellulose, cellulose phosphate, cellulose sulfate, cellulose acetate, cellulose propionate, cellulose butyrate, cellulose myrystate, cellulose palmitate, cellulose acetate.propionate, and cellulose acetate.butyrate; cellulose ethers as exemplified by methyl cellulose, ethyl cellulose, propyl cellulose, and butyl cellulose; vinyl resins as exemplified by polystyrene, polyvinyl chloride, polyvinyl acetate, polyvinyl butyral, polyvinyl acetal, polyvinyl alcohol, and polyvinyl pyrrolidone; copolymer resins as exemplified by a styrene/butadiene copolymer, a styrene/acrylonitrile copolymer, a styrene/butadiene/acrylonitrile copolymer, and a vinyl chloride/vinyl acetate copolymer; acrylic resins as exemplified by polymethyl methacrylate, polymethyl acrylate, polybutyl acrylate, polyacrylic acid, polymethacrylic acid, polyacrylamide, and polyacrylonitrile; polyesters as exemplified by polyethylene terephthalate; polyacrylate resins as exemplified by poly(4,4'-isopropylidene,diphenylene-co-1,4-cyclohexylenedimethylene carbonate), poly(ethylenedioxy-3,3'-phenylene thiocarbonate), poly(4,4'-isopropylidene,-diphenylene carbonate-coterephthalate), poly(4,4'-isopropylidene,diphenylene carbonate), poly(4,4'-sec-butylidene,diphenylene carbonate), and poly(4,4'-isopropylidene,diphenylene carbonate-block-oxyethylene); polyamides; polyimides; epoxy resins; phenol resins; polyolefins as exemplified by polyethylene, polypropylene, and chlorinated polyethylene; and natural polymers such as gelatin.

Besides, an antifoggant, an alkali forming agent, an automatic oxidant, a storage stabilizer, binding agent, an ultraviolet stabilizer, a fluorescent brightener, an antistatic agent, a filler, etc. may be used by appropriately adding them to the photosensitive layer 3.

The above components in the photosensitive layer 3 may preferably be mixed in the following proportions.

The reducing agent may preferably be contained in an amount of from 0.05 mol to 3 mols, and more preferably from 0.2 mols to 1.3 mols, per mol of the organic silver salt.

The organic silver salt used may preferably be in an amount of from 0.3 $g/m^2$ to 30 $g/m^2$, particularly preferably from 0.7 $g/m^2$ to 15 $g/m^2$, and more preferably from 1.2 $g/m^2$ to 8 $g/m^2$.

The silver halide may preferably be contained in an amount of from 0.001 mol to 2 mols, and more preferably from 0.05 mol to 1 mol, per mol the organic silver salt. In the case when the tone modifier is used, it may desirably be used in an amount ranging from 0.01 mol to 5 mols, preferably from 0.05 mol to 2 mols, and more preferably from 0.08 mol to 1 mol, per mol of the organic silver salt.

The binder optionally contained may preferably be in an amount of from 0 part by weight to 10 parts by weight, and more preferably from 0.5 part by weight to 5 parts by weight, per one part by weight of the organic silver salt.

The photosensitive layer 3 may be formed by applying to the support 4 as shown in FIG. 1, a solution prepared by dissolving the above components together with the binder appropriately used, followed by drying. Alternatively, in the case when the strength can be maintained by the binder itself, the above essential components may be incorporated into a film or sheet formed of the binder, without use of the support 4. Thus the heat-developable photosensitive material of the present invention can be formed.

As the support 4 used in the present invention, it can be selected from extensively various ones. The support may typically include synthetic films such as polyethylene film, polypropylene film, polyethylene terephthalate film, polycarbonate film and cellulose acetate film, synthetic papers, papers coated with a resin film such as polyethylene film, metal sheets such as an aluminum sheet, synthetic resin films having a metal deposited film, and glass sheets.

A backing layer may also be provided on the back (the side on which no photosensitive layer 3 is provided) of the support 4 so that halation, curl, static marks or abrasion can be prevented and transport performance can be improved.

Materials used in the backing layer may include hydrophilic or hydrophobic polymers such as gelatin, polyvinyl alcohol, starch, polyacrylamide, casein, a styrene/maleic anhydride copolymer, alkylketene dimers, polyurethane, vinylidene chloride, a styrene/-butadiene copolymer, a methyl methacrylate/acrylate copolymer and a methyl methacrylate/butadiene copolymer. The backing layer can be readily provided by applying a coating solution prepared by dissolving, dispersing or emulsifying any of these materials alone or together with components such as a hardening agent, a pigment, a dye and an anti-hydration agent.

Figure 2:
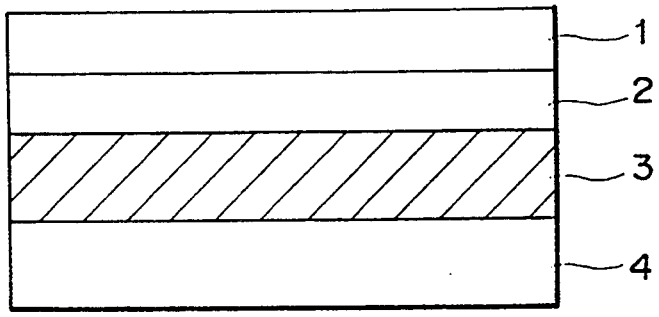
FIG. 2 is a side cross section to show another example of the heat-developable photosensitive material according to the present invention.

The heat-developable photosensitive material of the present invention may be comprised of, as shown in FIG. 2, the photosensitive layer 3, the hydrophobic polymeric layer 2 and the water-soluble polymeric layer 1 which are, in the named order, laminated to the support 4. A water-soluble polymeric layer or a hydrophobic polymeric layer may further be provided on the hydrophobic polymeric layer 2 of FIG. 1 or the water-soluble polymeric layer 1 of FIG. 2, respectively.

Each layer of the heat-developable photosensitive material of the present invention can be formed by coating as exemplified by dipping, air-knife coating and curtain coating.

The heat-developable photosensitive material is subjected to imagewise exposure and heating (heat development), where the organic silver salt and the reducing agent react at the exposed area to cause oxidation-reduction reaction, and the metallic silver produced as a result of the reaction forms a blackened image. It can also form a pattern corresponding with the difference in light-absorption, utilizing light-absorbing properties of an oxidized product formed by the oxidation-reduction reaction (a product by oxidation of the reducing agent). More specifically, light with a specific wavelength is absorbed at the area where the oxidized product has been formed (an imagewise exposed area) and light is less absorbed at the area where no oxidized product has been formed (an imagewise unexposed area). Thus there are differences in light-absorbing properties, and a pattern corresponding therewith can be formed.

Utilizing the light-absorbing properties of the oxidized product, it is also possible for the heat-developable photosensitive material of the present invention to form a pattern comprised of a polymerized area and an unpolymerized area (hereinafter "polymerized-unpolymerized pattern"). That is, the photosensitive layer according to the present invention may be incorporated with a polymerizable polymer precursor and a photopolymerization initiator, followed by imagewise exposure, heating (heat development) and polymerization exposure, so that the polymerized-unpolymerized pattern can be formed. The mechanism by which the polymerized-unpolymerized pattern is formed is that in the area where the oxidized product has been formed no polymerization proceeds because of the light absorption attributable to the oxidized product, and in the area where the oxidized product has not been formed the polymerization proceeds.

The polymerizable polymer precursor and the photopolymerization initiator may be contained in the photosensitive layer. Alternatively, a polymerizing layer containing the polymerizable polymer precursor and photopolymerization initiator may be provided separately from the photosensitive layer. The photosensitive layer and the polymerizing layer may be formed in laminae. Alternatively, they may hold a support between them, one side of which the photosensitive layer is provided and the other side of which the polymerizing layer is provided.

The photopolymerization initiator used in the photosensitive material of the present invention includes, for example, carbonyl compounds, sulfur compounds, halogen compounds, photopolymerization initiators of a redox type, and initiators of a peroxide type sensitized with a dye such as pyrylium.

Stated specifically, the carbonyl compounds may include diketones as exemplified by benzyl, 4,4'-dimethoxybenzyl, diacetyl, and camphorquinone; benzophenones as exemplified by 4,4'-bis(diethylamino)benzophenone, and 4,4'-dimethoxybenzophenone; acetophenones as exemplified by acetophenone, and 4-methoxyacetophenone; benzoin alkyl ethers; thioxanthones as exemplified by 2-chlorothioxanthone, 2,4-dichlorothioxanthone, 2,4-diethylthioxanthone, and thioxanthone-3-carboxylic acid-$\beta$-methoxy ethyl ester; chalcones and styrylketones having a dialkylamino group; and coumarins as exemplified by 3,3'-carbonylbis(7-methoxycoumarin), and 3,3'-carbonylbis(7-diethylaminocoumarin).

The sulfur compounds include, for example, dibenzothiazolyl sulfide, decylphenyl sulfide, and disulfides.

The halogen compounds include, for example, carbon tetrabromide, quinolinesulfonyl chloride, and S-triazines having a trihalomethyl group.

The photopolymerization initiators of redox type include those used in combination of a trivalent iron ionic compound (as exemplified by ferric ammonium citrate) with a peroxide, and those used in combination of a photoreducing coloring matter such as riboflavin or Methylene Blue with a reducing agent such as triethanolamine or ascorbic acid.

In the photopolymerization initiator described above (including the sensitizer), two or more photopolymerization initiators can also be used in combination to effect a more efficient photopolymerization reaction.

Such combination of the photopolymerization initiators includes a combination of chalcones having a dialkylamino group and styrylketones or coumarins, with S-triazines having a trihalomethyl group or camphorquinone.

As the polymerizable polymer precursor used in the photosensitive material of the present invention, a compound having at least one reactive vinyl group its one molecule can be utilized.

The reactive vinyl group in these compounds may include substituted or unsubstituted vinyl groups having polymerization reactivity, as exemplified by styrene vinyl groups, acrylic acid vinyl groups, methacrylic acid vinyl groups, allyl vinyl groups, vinyl ethers, as well as ester vinyl groups such as vinyl acetate.

Specific examples of the polymerizable polymer precursor satisfying such conditions are as follows.

They may include monovalent monomers as exemplified by styrene, methylstyrene, chlorostyrene, bromostyrene, methoxystyrene, dimethylaminostyrene, cyanostyrene, nitrostyrene, hydroxystyrene, aminostyrene, carboxystyrene, acrylic acid, methyl acrylate, ethyl acrylate, cyclohexyl acrylate, acrylamide, methacrylic acid, methyl methacrylate, ethyl methacrylate, propyl methacrylate, butyl methacrylate, phenyl methacrylate, cyclohexyl methacrylate, vinyl pyridine, N-vinylpyrrolidone, N-vinylimidazole, 2-vinylimidazole, N-methyl-2-vinylimidazole, propyl vinyl ether, butyl vinyl ether, isobutyl vinyl ether, β-chloroethyl vinyl ether, phenyl vinyl ether, p-methylphenyl vinyl ether, and p-chlorophenyl vinyl ether; divalent monomers as exemplified by divinylbenzene, distyryl oxalate, distyryl malonate, distyryl succinate, distyryl glutarate, distyryl adipate, distyryl maleate, distyryl fumarate, distyryl β,β'-dimethylglutarate, distyryl 2-bromoglutarate, distyryl α,α'-dichloroglutarate, distyryl terephthalate, oxalic acid di(ethyl acrylate), oxalic acid di(methyl acrylate), malonic acid di(ethyl acrylate), malonic acid di(methyl ethyl acrylate), succinic acid di(ethyl acrylate), glutaric acid di(ethyl acrylate), adipic acid di(ethyl acrylate), maleic acid di(ethyl acrylate), fumaric acid di(ethyl acrylate), β,β'-dimethylglutaric acid di(ethyl acrylate), ethylenediacrylamide, propylenediacrylamide, 1,4-phenylenediacrylamide, 1,4-phenylenebis(oxyethyl acrylate), 1,4-phenylenebis(oxymethyl ethyl acrylate), 1,4-bis(acryloyloxyethoxy)cyclohexane, 1,4-bis(acryloyloxymethylethoxy)cyclohexane, 1,4-bis(acryloyloxyethoxycarbamoyl)benzene, 1,4-bis(acryloyloxymethylethoxycarbamoyl)benzene, 1,4-bis(acryloyloxyethoxycarbamoyl)cyclohexane, bis(acryloyloxyethoxycarbamoylcyclohexyl)methane, oxalic acid di(ethyl methacrylate), oxalic acid di(methyl ethyl methacrylate), malonic acid di(ethyl methacrylate), malonic acid di(methyl ethyl methacrylate), succinic acid di(ethyl methacrylate), succinic acid di(methyl ethyl methacrylate), glutaric acid di(ethyl methacrylate), adipic acid di(ethyl methacrylate), maleic acid di(ethyl methacrylate), fumaric acid di(ethyl methacrylate), fumaric acid di(methyl ethyl methacrylate), β,β'-dimethylglutaric acid di(ethyl methacrylate), 1,4-phenylenebis(oxyethyl methacrylate), and 1,4-bis(methacryloyloxyethoxy) cyclohexane acryloyloxyethoxyethyl vinyl ether; trivalent monomers as exemplified by pentaerythritol triacrylate, pentaerythritol trimethacrylate, pentaerythritol tri(hydroxystyrene), dipentaerythritol hexaacrylate, cyanuric acid triacrylate, cyanuric acid trimethyacrylate, 1,1,1-trimethylolpropane triacrylate, 1,1,1-trimethylolpropane trimethacrylate, cyanuric acid tri(ethyl acrylate), 1,1,1-trimethylolpropane tri(ethyl acrylate), cyanuric acid tri(ethyl vinyl ether), a condensate of 1,1,1-trimethylolpropane(toluenediisocyanate) with hydroxyethyl acrylate, and a condensate of 1,1,1-trimethylolpropane(hexanediisocyanate) with p-hydroxystyrene; tetravalent monomers as exemplified by ethylenetetraacrylamide, and propylenetetraacrylamide; and hexavalent monomers such as dipentaerythritol hexaacrylate.

The above polymerizable polymer precursors may be used in combination of two or more kinds.

In the instance where the polymerizable polymer precursor and the photopolymerization initiator are used in the heat-developable photosensitive material of the present invention, the photopolymerization initiator may preferably be contained in an amount of from 0.01 mol to 10 mols, and more preferably from 0.5 mol to 3.0 mols, per mole of the reducing agent. The photopolymerization initiator may preferably be in an amount of from 0.1 part by weight to 30 parts by weight, and more preferably from 0.5 part by weight to 10 parts by weight, based on 100 parts by weight of the polymerizable polymer precursor.

The photosensitive layer 3 may preferably have a thickness of from 0.1 μm to 50 μm, more preferably from 1 μm to 30 μm, and particularly preferably from 2 μm to 20 μm. In the case when the polymerizing layer is provided separately from the photosensitive layer 3, the polymerizing layer may have the thickness in the same range as the range of the thickness of the photosensitive layer 3.

As light sources used in the steps of imagewise exposure and polymerization exposure, usable are, for example, sunlight, tungsten lamps, mercury lamps, halogen lamps, xenon lamps, fluorescent lamps. LEDs, and lasers, and the wavelength of the light used in these steps may be the same or different. Even if the light having the same wavelength is used, the latent image can be sufficiently written with use of light having an intensity of the level that does not cause photopolymerization in the step of imagewise exposure, since the photosensitive silver halide usually has a sufficiently higher photosensitivity than the photopolymerization initiator. For example, in the step of imagewise exposure, the exposure may be carried out using light that may give about 1 $mJ/cm^2$ or less at the surface of the photosensitive material. In the step of polymerization exposure, the exposure may be carried out using light that may give about 500 $mJ/cm^2$ or less at the surface of the photosensitive material.

Various kinds of means are available as a means of heat-developing the photosensitive :material of the present invention. For example, the photosensitive material may be brought into contact with a simple heating plate. Alternatively, it may be brought into contact with a heated drum. In some instances, it may also be passed through a heated space. It may also be heated by high-frequency heating or using laser beams. It is suitable to carry out the heating at a temperature of from 80° C. to 160° C., preferably from 100° C. to 160° C., and more preferably from 100° C. to 140° C. The heating time may be elongated or shortened, whereby a higher temperature or lower temperature within the above range can be used. Developing time may be usually from about 1 second to about 60 seconds, and preferably form 3 seconds to 20 seconds.

The heat-developable photosensitive material of the present invention has the hydrophobic polymeric layer and the water-soluble polymeric layer, so that the moisture in the air can be prevented from permeating into the photosensitive layer and also the components of the photosensitive layer can be prevented from migrating to the surface of the photosensitive material. Hence, no lowering of sensitivity may occur even after storage over a long period of time and also the surface of the photosensitive layer can be free from adhesion of a nonwoven fabric constituting a heating element to the surface of the photosensitive material and free from scratches. Sharp images free from distortion can also be obtained according to the present invention.

EXAMPLES

The present invention will be described below in greater detail by giving Examples. In the following, "part(s)" indicates "part(s) by weight"

Example 1

A photosensitive layer coating solution with the following composition was prepared using a homomixer in an environment of 25° C., 30% RH.

| | |
|---|---|
| Silver behenate | 100 parts |
| Behenic acid | 40 parts |
| Azelaic acid | 12 parts |
| Silver bromide | 8 parts |
| Polyvinyl butyral | 160 parts |
| 2,2'-Methylenebis(6-tert-butyl-4-methylphenol) | 80 parts |
| Phthalazinone | 12 parts |
| 3-Ethyl-5-[(3-methyl-2-thiazolinidene)ethylidene] rhodanine | 0.008 part |
| Xylene | 1,000 parts |
| n-Butanol | 500 parts |

The photosensitive layer coating solution thus prepared was coated on a polyethylene terephthalate (PET) film so as to give a dried-coating thickness of 5 μm, followed by drying to form a photosensitive layer. On this photosensitive layer, polyvinyl alcohol (NH-18, available from Nihon Gosei Kako Co., Ltd.) was coated so as to give a dried-coating thickness of 3 μm, followed by drying to form a water-soluble polymeric layer. Subsequently, on this water-soluble polymeric layer, polymethyl methacrylate (DIANAL BR-83, available from Mitsubishi Rayon Co., Ltd.) was coated so as to give a dried-coating thickness of 3 μm, followed by drying to form a hydrophobic polymeric layer. Thus, heat-developable photosensitive materials of the present invention were obtained.

One of the heat-developable photosensitive materials thus produced was exposed to light using a 150 W tungsten lamp as a light source. Next, heat development was carried out using a heat-developing machine (DCX-Processor, manufactured by Oriental Photo Industrial Co., Ltd.). As a result, a distortion-free, sharp image was obtained. The heat development was carried out under conditions of 120° C. for 10 seconds. For the heat-developable photosensitive material having been subjected to image formation, transmittance at 550 nm was measured to obtain the results shown in Table 1.

The remaining heat-developable photosensitive material, produced as described above, was stored in an environment of 50° C. and 80% RH for 3 days, and thereafter subjected to the imagewise exposure and heat development in the same manner as described above. As a result, a distortion-free, sharp image was obtained. Its transmittance at 550 nm was also similarly measured. Results of the measurement are shown in Table 1;

Visual evaluation was also made on whether or not a nonwoven fabric of the heat-developing machine had adhered to the surface of the heat-developable photosensitive materials and also on whether or not any scratches had occurred thereon. Results thereof are also shown in Table 1.

Example 2

Heat-developable photosensitive materials of the present invention were produced in the same manner as in Example 1 except that the polymethyl methacrylate used therein was replaced with saturated polyester resin (BYRON 200, available from Toyobo Co., Ltd.). The heat-developable photosensitive materials thus produced were evaluated in the same manner as in Example 1. Results obtained are shown in Table 1.

Example 3

Heat-developable photosensitive materials of the present invention were produced in the same manner as in Example 1 except that the polymethyl methacrylate used therein was replaced with polyacrylonitrile resin (N-23, available from Toyobo Co., Ltd.). The heat-developable photosensitive materials thus produced were evaluated in the same manner as in Example 1. Results obtained are shown in Table 1.

Example 4

Heat-developable photosensitive materials of the present invention were produced in the same manner as in Example 1 except that the polyvinyl alcohol used therein was replaced with polyvinyl alcohol to which colloidal silica (SNOWTEX-O, available from Nissan Chemical Industries, Ltd.) had been added. The polyvinyl alcohol and the colloidal silica were mixed in equivalent amounts in weight ratio. The heat-developable photosensitive materials thus produced were evaluated in the same manner as in Example 1. Results of evaluation are shown in Table 1.

Example 5

Heat-developable photosensitive materials of the present invention were produced in the same manner as in Example 1 except that the polyvinyl alcohol used therein was replaced with gelatin (Porcine Skin 300 Type, available from Sigma Co.). The heat-developable photosensitive materials thus produced were evaluated in the same manner as in Example 1. Results of evaluation are shown in Table 1.

Examples 6 to 10

Heat-developable photosensitive materials of the present invention were produced in the same manner as in Example 1 except that the hydrophobic polymeric layer and the water-soluble polymeric layer were laminated in the order reverse to Example 1, i.e., in the order of the photosensitive layer, the hydrophobic polymeric layer and the water-soluble polymeric layer (Example 6).

Photosensitive materials, corresponding to Examples 7, 8, 9 and 10, were produced in the same manner as in Examples 2, 3, 4 and 5, respectively, except that the hydrophobic polymeric layer and the water-soluble polymeric layer were laminated in the order reverse to these Examples.

The five kinds of photosensitive materials thus produced were evaluated in the same manner as in Example 1. Results of evaluation are shown in Table 1.

Comparative Example 1

Heat-developable photosensitive materials were produced in the same manner as in Example 1 except that the polymethyl methacrylate used therein was not coated. The heat-developable photosensitive materials thus produced were evaluated in the same manner as in Example 1. Results of evaluation are shown in Table 1.

Comparative Example 2

Heat-developable photosensitive materials were produced in the same manner as in Example 1 except that the polyvinyl alcohol used therein was not coated. The heat-developable photosensitive materials thus produced were evaluated in the same manner as in Example 1. Results of evaluation are shown in Table 1.

TABLE 1

| | Before storage at high temperature and high humidity | | | | After storage at 50° C., 80% RH for 3 days | | | |
|---|---|---|---|---|---|---|---|---|
| | Exposed area transmittance | Unexposed area transmittance | Adhesion to nonwoven cloth | Scratch | Exposed area transmittance | Unexposed area transmittance | Adhesion to nonwoven cloth | Scratch |
| Example: | | | | | | | | |
| 1 | 10.8% | 75.0% | None | None | 13.0% | 72.0% | None | None |
| 2 | 11.5% | 78.0% | None | None | 12.0% | 77.5% | None | None |
| 3 | 10.6% | 76.2% | None | None | 11.9% | 74.0% | None | None |
| 4 | 12.3% | 73.9% | None | None | 14.4% | 72.2% | None | None |
| 5 | 9.5% | 74.1% | None | None | 11.5% | 73.3% | None | None |
| 6 | 10.1% | 73.2% | None | None | 15.0% | 73.2% | None | None |
| 7 | 11.8% | 73.0% | None | None | 11.5% | 71.3% | None | None |
| 8 | 11.5% | 78.4% | None | None | 10.8% | 75.2% | None | None |
| 9 | 11.5% | 73.5% | None | None | 11.9% | 73.0% | None | None |
| 10 | 11.0% | 73.5% | None | None | 11.3% | 71.7% | None | None |
| Comparative Example: | | | | | | | | |
| 1 | 9.9% | 73.0% | None | None | 72.0% | 72.9% | None | None |
| 2 | 11.0% | 74.5% | Occur | Occur | 12.5% | 73.6% | Occur | Occur |

Distortion-free, sharp images were obtained in all of Examples 1 to 10, but in Comparative Examples 1 and 2 image distortion was seen in places.

Example 11

A heat-developable photosensitive material of the present invention was produced in the same manner as in Example 1 except that the hydrophobic polymeric layer was replaced with one comprised of polymethyl methacrylate (DIANAL BR-83, available from Mitsubishi Rayon Co., Ltd.) to which 2-(2'-hydroxy-5'-methylphenyl)benzotriazole (available from Johoku Chemical Industry Co., Ltd.) serving as an ultraviolet absorbent had been added. The ultraviolet absorbent was added in an amount of 0.5% by weight based on the hydrophobic polymeric layer.

The heat-developable photosensitive material thus produced was subjected to imagewise exposure and heat development in the same manner as in Example 1. After the imagewise exposure and heat development, it was confirmed whether or not the imagewise unexposed areas of the heat-developable photosensitive material blackened.

Whether or not such areas blackened was confirmed 5 minutes and 30 minutes after completion of the heat development, using an X-ray photographic viewer ICH 3D (about 8,000 lux on the surface of the photosensitive material), manufactured by K. K. Moriyama X-ray Youhin. As a result, no blackening of the imagewise unexposed areas was seen in the above heat-developable photosensitive material.

Meanwhile, the heat-developable photosensitive material of Example 1 was also observed to confirm whether or not the imagewise unexposed areas blackened. As a result, although to an extent not problematic in practical use, the imagewise unexposed areas slightly blackened after lapse of 30 minutes.

What is claimed is:

1. A heat-developable photosensitive material comprises a support and provided thereon in sequence from the support side, (a) a photosensitive layer containing at least an organic silver salt, a silver halide and a reducing agent, (b) a water-soluble polymeric layer containing a water-soluble polymeric material, and (c) a hydrophobic polymeric layer containing a hydrophobic polymeric material.

2. The heat-developable photosensitive material according to claim 1, wherein said water-soluble polymeric layer or said hydrophobic polymeric layer contains silica.

3. The heat-developable photosensitive material according to claim 1, wherein said water-soluble polymeric layer or said hydrophobic polymeric layer contains an ultraviolet absorbent.

4. The heat-developable photosensitive material according to claim 1, having an ultraviolet absorbing layer containing an ultraviolet absorbent.

5. The heat-developable photosensitive material according to claim 1, wherein said photosensitive layer contains a polymerizable polymer precursor and a photopolymerization initiator.

6. The heat-developable photosensitive material according to claim 1, having a polymerizing layer containing a polymerizable polymer precursor and a photopolymerization initiator.

* * * * *